US011232923B2

(12) United States Patent
Fasano

(10) Patent No.: US 11,232,923 B2
(45) Date of Patent: Jan. 25, 2022

(54) HIGH VOLTAGE LATCHING RELAY WITH MANUAL ACTUATOR

(71) Applicant: Carling Technologies, Inc., Plainville, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 341 days.

(21) Appl. No.: 16/448,279

(22) Filed: Jun. 21, 2019

(65) Prior Publication Data

US 2020/0402754 A1 Dec. 24, 2020

(51) Int. Cl.

| | |
|---|---|
| ***H01H 51/14*** | (2006.01) |
| ***H01H 50/54*** | (2006.01) |
| ***H01H 50/58*** | (2006.01) |
| ***H01H 50/64*** | (2006.01) |
| ***H01H 50/02*** | (2006.01) |

(52) U.S. Cl.

CPC ..... *H01H 51/14* (2013.01); *H01H 50/02* (2013.01); *H01H 50/541* (2013.01); *H01H 50/58* (2013.01); *H01H 50/641* (2013.01); *H01H 50/643* (2013.01); *H01H 2239/044* (2013.01)

(58) Field of Classification Search

CPC .. H01H 2239/044; H01H 33/596; H01H 3/46; H01H 50/02; H01H 50/541; H01H 50/58; H01H 50/641; H01H 50/643; H01H 51/12; H01H 51/14

See application file for complete search history.

(56) References Cited

U.S. PATENT DOCUMENTS

| | | | | |
|---|---|---|---|---|
| 982,346 A * | 1/1911 | Brown | H01H 51/12 361/210 |
| 1,447,917 A | 3/1923 | Wilson | |
| 1,916,942 A | 7/1933 | Wright | |
| 2,530,194 A * | 11/1950 | Ferry | H01H 51/08 335/265 |
| 2,878,338 A | 3/1959 | Gribble | |
| 3,201,544 A | 8/1965 | Diamant | |
| 3,566,320 A | 2/1971 | Bakes | |

(Continued)

FOREIGN PATENT DOCUMENTS

| | | |
|---|---|---|
| DE | 607862 C | 1/1935 |
| DE | 3230562 | 2/1984 |

(Continued)

*Primary Examiner* — Bernard Rojas

(74) *Attorney, Agent, or Firm* — Forge IP, PLLC

(57) ABSTRACT

A latching relay includes first and second coils and a common plunger operatively connected therebetween such that activation of the first coil moves the plunger in a first direction and activation of the second coil moves the plunger in a second direction, opposite the first direction, the first and second directions lying in a first plane. A limit switch includes a common contact and first and second coil contacts, where a position of the common contact is alternately switched between electrical connection to either the first or second coil contact based on a position of the plunger. A slide toggle accessible by a user is operatively connected to the plunger and slideable together with the plunger such that actuation of the slide toggle by the user causes manual actuation of the plunger. The slide toggle is slideable in a second plane parallel to the first plane.

19 Claims, 2 Drawing Sheets

(56) References Cited

U.S. PATENT DOCUMENTS

| | | | | |
|---|---|---|---|---|
| 5,072,328 | A | 12/1991 | Dvorak et al. | |
| 6,714,106 | B1 * | 3/2004 | Czarnecki | H01H 3/22 200/331 |
| 10,276,335 | B2 | 4/2019 | Fasano | |
| 2014/0062623 | A1 | 3/2014 | Fasano | |
| 2018/0218864 | A1 * | 8/2018 | Fasano | H01H 51/14 |

FOREIGN PATENT DOCUMENTS

| | | | |
|---|---|---|---|
| EP | 2940708 | | 11/2015 |
| EP | 3355334 | | 8/2018 |
| FR | 2434471 | A1 | 3/1980 |
| GB | 2030368 | | 4/1980 |
| JP | S51-039172 | | 9/1976 |
| JP | S6278802 | | 4/1987 |
| JP | 2009026651 | | 2/2009 |
| JP | 2018120861 | | 8/2018 |

* cited by examiner

HIGH VOLTAGE LATCHING RELAY WITH MANUAL ACTUATOR

FIELD OF THE INVENTION

The invention relates to a latching relay used for high voltage applications, and more specifically, the invention relates to a latching relay that includes high voltage circuit interrupting capacity.

BACKGROUND OF THE INVENTION

Relays have been used in various applications for many years. A relay is a remotely operated switching device that typically includes a coil and at least one set of contacts providing switched power to a connected device. Based on the power applied to the coil, the contacts change state to turn power on/off to the connected device. When power is applied to the coil, the contacts move to an activated state (this could be opened or closed), and when power is removed from the coil, the contacts move to the default state (this again, could be opened or closed).

A latching relay is a particular type of relay that is also known for use in various applications. Latching relays function differently than a "standard" relay described above in that once the relay changes state, the contacts remain in the last position even when power is removed. So, for example, if power is applied to the coil, the contacts will change state (whether opening or closing). When power is removed from the coil, rather than changing back to a default state, the latching relay will remain in the last state. Only by the application of power to change the state of the contacts again, will the latching relay operate.

Traditional latching relays typically included a permanent magnet in conjunction with a coil. In order to change the state of the contacts in the latching relay, it was required to change the polarity of the power applied to the coil to offset the flux generated by the permanent magnet. These types of traditional latching relays were also typically biased by a spring.

One of the problems with traditional latching relays was the ability for limited application in high voltage applications. High voltage applications typically are associated with high power transfer and therefore, the switching devices used in these applications must be able to effectively and safely switch even under load. The structure described above (permanent magnet used with a coil) provided limited high voltage interrupting capacity.

This problem was obviated by the relay disclosed in my previous U.S. Pat. No. 10,276,335, titled "High Voltage DC Relay." The invention disclosed herein provides an even more advantageous design, as it achieves all of the benefits disclosed in my previous U.S. Pat. No. 10,276,335, while at the same time also allowing for manual actuation of the relay in addition to electronic actuation.

SUMMARY OF THE INVENTION

The present invention provides for a latching relay that may be used in high voltage applications and allow for switching even under load. In other words, it provides for high current interrupting capacity. For purposes of this application, the term "high voltage" is applied to applications in which is used a voltage higher than that used for power distribution. The lower limit is usually taken as 8,700V according to the National Electrical Safety Code (NFPA 70). However, it should be understood that these voltages do not form any part of the claimed invention and should not be construed as limiting in any way.

In accordance with one embodiment of the present invention, a latching relay includes a first coil, a second coil and a common plunger operatively connected between the first coil and the second coil such that activation of the first coil moves the plunger in a first direction to a first position and activation of the second coil moves the plunger in a second direction, opposite to the first direction, to a second position, the first direction and the second direction lying in a first plane.

The latching relay also includes a limit switch including a common contact, a first coil contact and a second coil contact, where a position of the common contact is alternately switched between electrical connection to either the first coil contact or the second coil contact based on a position of the plunger. The first coil contact is electrically connected to the first coil and the second coil contact is electrically connected to the second coil such that when electrical power is applied to the common contact, the electrical power is alternately applied to either the first coil or the second coil depending on the position of the common contact.

Further, the latching relay includes a slide toggle accessible by a user, the slide toggle operatively connected to the common plunger and slideable together with the common plunger such that actuation of the slide toggle by the user causes manual actuation of the common plunger. The slide toggle is slideable in a second plane that is parallel to the first plane.

In some embodiments, the latching relay further includes a housing, and the slide toggle is accessible through an opening in the housing. In certain of these embodiments, a portion of the slide toggle protrudes through the opening in the housing.

In some embodiments, a pin protrudes from the common plunger, and the slide toggle has an elongated slot formed therein, the elongated slot cooperating with the pin. In certain of these embodiments, the elongated slot extends in a direction generally perpendicular to the first plane and the second plane.

In some embodiments, the latching relay further includes a pair of load contacts moveable between a closed position in which power is supplied to a load and an open position in which power to the load is interrupted. In certain of these embodiments, the load contacts are in the closed position when the plunger is in its first position and the load contacts are in the open position when the plunger is in its second position. In certain embodiments, the pair of load contacts include a stationary load contact and a moveable load contact.

In some embodiments, a moveable load contact arm is operatively connected to the plunger, and the moveable load contact is disposed on the moveable load contact arm. In certain of these embodiments, a linkage is operatively connected between the plunger, the moveable load contact arm and the limit switch, wherein movement of the plunger causes simultaneous movement of both the moveable contact arm and the common contact of the limit switch via the linkage.

In some embodiments, a pin protrudes from the common plunger, and the linkage has an elongated slot formed therein, the elongated slot cooperating with the pin. In certain of these embodiments, the slide toggle has an elongated slot formed therein, the elongated slot cooperating with the pin. In certain embodiments, the elongated slot formed in the slide toggle extends in a direction generally perpendicular to the first plane and the second plane.

In some embodiments, the latching relay further includes an arc extinguisher positioned adjacent the pair of load contacts, the arc extinguisher adapted to facilitate quenching of an arc created between the pair of load contacts. In certain of these embodiments, the arc extinguisher includes a plurality of arc quenching plates. In certain embodiments, the latching relay further includes a housing in which are disposed at least the pair of load contacts and the arc extinguisher. In certain embodiments, the housing has formed therein at least one vent hole in order to allow gases and/or debris to be vented out of the housing. In certain of these embodiments, the at least one vent hole comprises a plurality of vent holes positioned adjacent to the arc extinguisher.

In some embodiments, the first coil, the second coil and the limit switch are all mounted on a common circuit board. In some embodiments, the common contact of the limit switch is biased toward electrical connection to either the first coil contact or the second coil contact, but is moveable against the bias toward electrical connection with the other of the first coil contact or the second coil contact based on the position of the plunger.

In accordance with another aspect of the present invention, a latching relay includes a housing, a first coil disposed within the housing, a second coil disposed within the housing and a common plunger disposed within the housing and operatively connected between the first coil and the second coil. Activation of the first coil moves the plunger in a first direction to a first position and activation of the second coil moves the plunger in a second direction, opposite to the first direction, to a second position, where the first direction and the second direction lie in a first plane. The common plunger has a pin protruding therefrom.

A limit switch is disposed within the housing and includes a common contact, a first coil contact and a second coil contact. A position of the common contact is alternately switched between electrical connection to either the first coil contact or the second coil contact based on a position of the plunger. The first coil contact is electrically connected to the first coil and the second coil contact is electrically connected to the second coil such that when electrical power is applied to the common contact, the electrical power is alternately applied to either the first coil or the second coil depending on the position of the common contact.

A slide toggle is accessible by a user through an opening formed in the housing, the slide toggle operatively connected to the common plunger and slideable together with the common plunger such that actuation of the slide toggle by the user causes manual actuation of the common plunger. The slide toggle is slideable in a second plane that is parallel to the first plane and has an elongated slot formed therein. The elongated slot extends in a direction generally perpendicular to the first plane and the second plane and cooperates with the pin protruding from the common plunger.

In some embodiments, a portion of the slide toggle protrudes through the opening in the housing.

Other features and advantages of the invention will become more apparent from consideration of the following drawings.

DETAILED DESCRIPTION OF THE INVENTION

Figure 1:
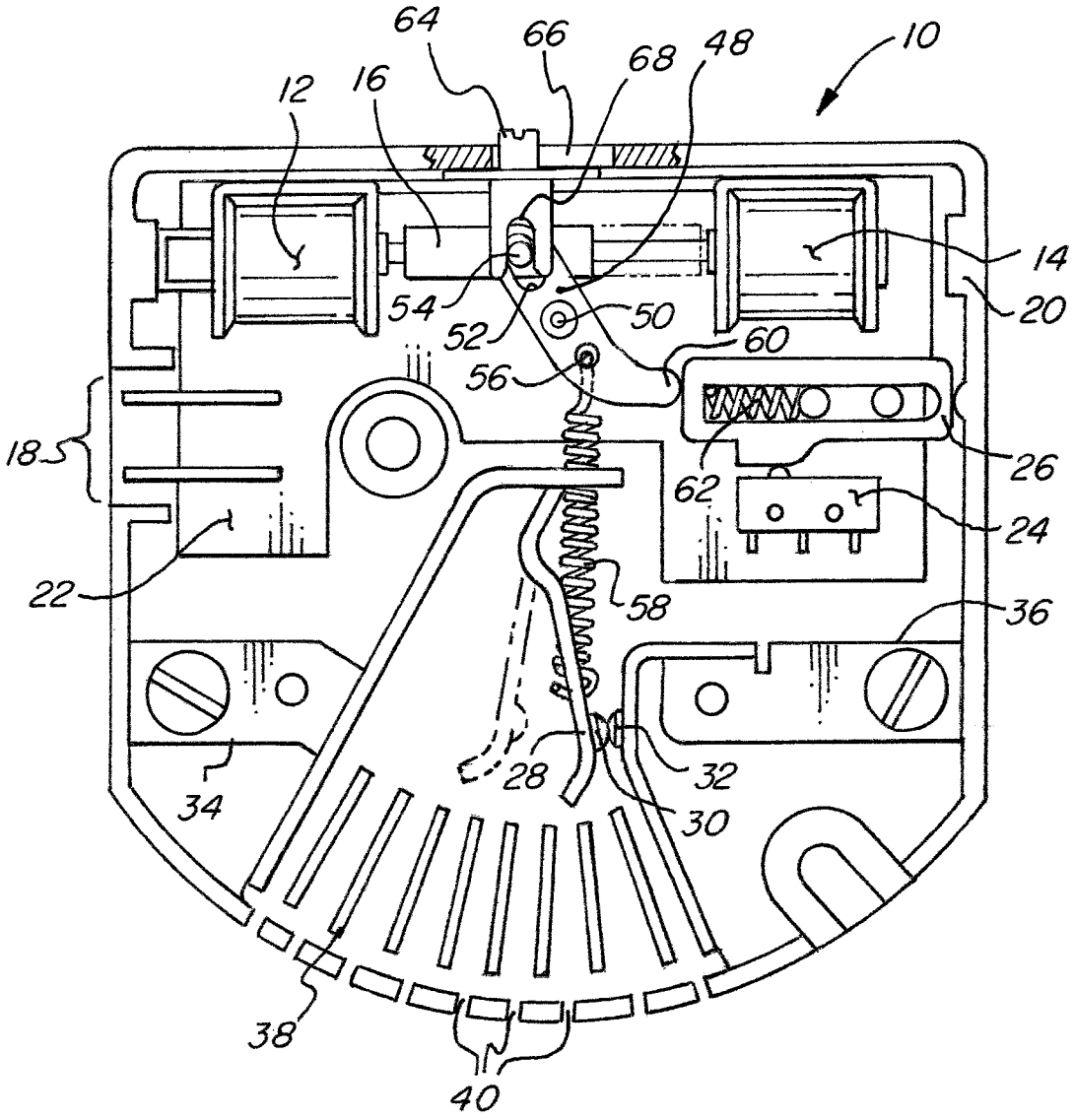
FIG. 1 is a side cut-away view of an exemplary configuration of the inventive latching relay.

FIG. 1 is an illustration of one exemplary configuration of a latching relay (10) in accordance with the present invention including a first coil (12), a second coil (14), and a common plunger (16) operatively connected between the first and second coils (12, 14). Relay coil terminals (18) are shown extending through a housing (20) for connection to a source of switched electrical power (not shown).

Both the first and second coils (12, 14) are shown positioned on a circuit board (22), which is in turn, positioned within the housing (20). A limit switch (24) is also shown positioned on the circuit board (22). A mechanical position indicator (26) is operatively connected between the plunger (16) and the limit switch (24), as is discussed more fully below.

A moveable contact arm (28), having a moveable contact (30) positioned on a distal end thereof, is vertically mounted in the latching relay housing (20) and is moveable between an open state (shown in dashed lines) and a closed state (shown in solid lines) relative to a stationary contact (32). Two load power terminals (34, 36) are shown, one to the left side of the housing (20) electrically connected to the moveable contact (30), and one to the right of the housing (20) electrically connected to the stationary contact (32).

An arc extinguisher in the form of a plurality of arc plates (38) is positioned at a bottom of the housing (20) and is positioned adjacent a path of travel of the moveable contact arm (28) when opening and closing. The arc extinguisher is adapted to facilitate quenching of an arc created between the load contacts (30, 32). Vent openings (40) are located in the bottom of the housing (20) adjacent to the arc plates (38) and along a path of travel of the moveable contact arm (28) such that gases and debris will be urged toward the vent openings (40) in order to facilitate the escape of such gases and debris.

Turning now to operation of the latching relay (10), the first coil (12), the second coil (14) and the common plunger (16) operatively connected therebetween are configured such that activation of the first coil (12) moves the plunger (16) in a first direction to a first position (i.e., toward the first coil (12)), as shown in solid lines in FIG. 1. On the other hand, activation of the second coil (14) moves the plunger (16) in a second direction, opposite to the first direction, to a second position (i.e., toward the second coil (14)), as shown in dashed lines in FIG. 1.

Figure 2:
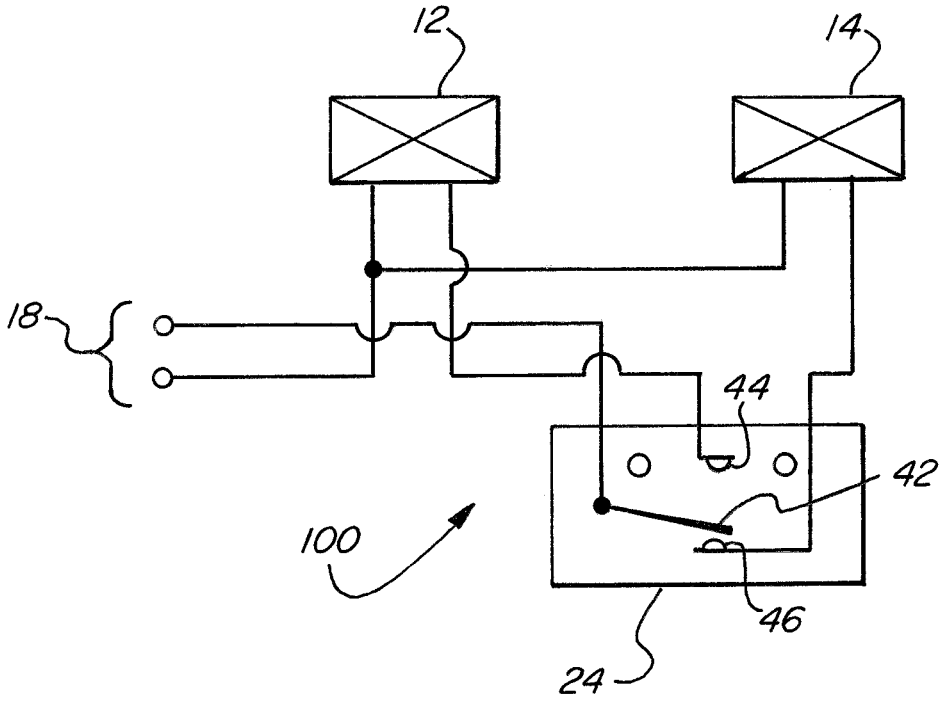
FIG. 2 is a schematic diagram of the latching relay circuit of FIG. 1 illustrating the electrical interconnections between the first and second coils and the limit switch.

Turning now to FIG. 2, a schematic diagram of the latching relay circuit (100) is shown. As shown, the limit switch (24) has a common contact (42), a first coil contact (44) and a second coil contact (46). A position of the common contact (42) is alternately switched between electrical connection to either the first coil contact (44) or the second coil contact (46) based on a position of the plunger (16), as more fully discussed below. The first coil contact (44) is electrically connected to the first coil (12) and the second coil contact (46) is electrically connected to the second coil (14) such that when electrical power is applied to the common contact (42) via the coil terminals (18), the electrical power is alternately applied to either the first coil (12) or the second coil (14) depending on the position of the common contact (42).

For example, with the common contact (42) in the position indicated in FIG. 2, upon application of electrical power to the coil terminals (18), power would be applied to the second coil (14), which in turn, would cause the plunger (16) to be drawn toward the second coil (14) and open the load contacts (30, 32). This would also function to change the contact connections within the limit switch (24) as will now be explained.

Turning again to FIG. 1, the latching relay (10) further includes a linkage (48) operatively connected between the plunger (16), the moveable load contact arm (28) and the limit switch (24), such that movement of the plunger (16) causes simultaneous movement of both the moveable contact arm (28) and the common contact (42) of the limit switch (24) via the linkage (48).

More specifically, the linkage (48) is shown to be pivotable about a pivot point (50). One end of linkage (48) is provided with a slot (52) that slideably engages a pin (54) disposed on the plunger (16) in order to allow translation of the sliding movement of the plunger (16) into pivoting movement of the linkage (48).

On an opposite side of the pivot point (50) is a pin (56) or the like to which is connected a spring (58). The other end of the spring (58) is connected to the moveable load contact arm (28). Thus, as the plunger (16) slides in one direction or the other, the linkage (48) pivots, thereby stretching the spring (58). When a certain point is reached, the force of the stretched spring (58) causes a rapid movement of the moveable load contact arm (28) to cause a rapid opening or closing of the load contacts (30, 32). The force of the spring (58) also ensures that the load contacts (30, 32) remain in contact when in the closed position.

As can also be seen, an end (60) of the linkage (48) is in contact with the mechanical position indicator (26) that is, in turn, operatively connected to the limit switch (24). The mechanical position indicator (26) may include a spring (62) or the like biasing the mechanical position indicator (26) toward the left, with respect to the orientation shown in FIG. 1. However, as shown, the mechanical position indicator (26) may be forced to move against the bias (i.e., to the right) by contact with the end (60) of the linkage (48) as shown in FIG. 1.

As will be recognized by those skilled in the art, when the mechanical position indicator (26) is positioned to the right (as shown in FIG. 1), the common contact (42) is in electrical communication with the second coil contact (46) (as shown in FIG. 2), whereas when the mechanical position indicator (26) is positioned to the left, the common contact (42) is in electrical communication with the first coil contact (44).

Thus, starting from the positions of components shown in solid lines in FIGS. 1 and 2 (i.e., with the load contacts (30, 32) closed such that the load would be receiving high voltage electrical power), upon application of electrical power to the coil terminals (18), power would be applied to the second coil (14), which in turn, would cause the plunger (16) to be drawn toward the second coil (14) and open the load contacts (30, 32). This would simultaneously cause the mechanical position indicator (26) to move to the left, thereby causing the common contact (42) of the limit switch (24) to move into electrical communication with the first coil contact (44).

Thus, the next time power is applied to the coil terminals (18), the electrical power would be applied to the first coil (12), which would function to pull the plunger (16) toward the first coil (12) and close the high voltage contacts (30, 32). This would also function to change the contact connections in the limit switch (24) to return to the position shown in FIG. 2.

In this manner, the latching relay (10) will change state upon the application of electrical power to the coil terminals (18), but will not change state until electrical power is again applied to the coil terminals (18).

This configuration requires the application of electrical power to drive the plunger from one coil to the other coil. This driving force provides the needed power to open the high voltage contacts even when under load. In other words, the driving of the plunger between a first and a second state allows for high current interrupting capacity.

In addition to the electrical actuation discussed above, the latching relay (10) further provides for local manual actuation by way of a slide toggle (64) accessible through an opening (66) provided in the housing (20), which slide toggle is slideable back and forth with, and parallel to, the common plunger (16). In the embodiment shown, the slide toggle (64) protrudes through the opening (66) in order to facilitate its manipulation by a user, although such is not strictly required. For example, the slide toggle (64) may be configured so that a user is required to insert a screwdriver or the like through the opening (66) in order to manipulate the slide toggle (64), thereby reducing the likelihood of inadvertent actuation.

The slide toggle (64) includes a slot (68) formed therein, which is disposed generally perpendicular to planes in which the slide toggle (24) and common plunger (16) reciprocate, in order to accommodate the movement of the slide toggle (24) and common plunger (16) together.

In the embodiment shown, the slot (68) cooperates with the same pin (54) as does the slot (52) provided in the linkage (48), although a separate pin or the like may instead be employed to cooperate with the slot (68), if desired.

The slide toggle (64) thus allows for the common plunger (16) to be reciprocated manually in a very similar manner to how the plunger may be reciprocated electronically by way of the first and second coils (12, 14), as described above in detail.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A latching relay comprising:

a first coil;

a second coil;

a common plunger operatively connected between said first coil and said second coil such that activation of said first coil moves said plunger in a first direction to a first position and activation of said second coil moves said plunger in a second direction, opposite to the first direction, to a second position, wherein the first direction and the second direction lie in a first plane, said common plunger having a pin protruding therefrom;

a limit switch comprising a common contact, a first coil contact and a second coil contact, wherein a position of said common contact is alternately switched between electrical connection to either the first coil contact or the second coil contact based on a position of said plunger;

said first coil contact being electrically connected to said first coil and said second coil contact being electrically connected to said second coil such that when electrical power is applied to the common contact, the electrical power is alternately applied to either the first coil or the second coil depending on the position of the common contact; and a slide toggle accessible by a user, said slide toggle operatively connected to said common plunger and slideable together with said common plunger such that actuation of the slide toggle by the user causes manual actuation of said common plunger, said slide toggle being slideable in a second plane that is parallel to the first plane, and having an elongated slot formed therein, said elongated slot cooperating with the pin protruding from said common plunger.

2. The latching relay of claim 1 further comprising a housing, and wherein said slide toggle is accessible through an opening in the housing.

3. The latching relay of claim 2 wherein a portion of said slide toggle protrudes through the opening in the housing.

4. The latching relay of claim 1 wherein the elongated slot extends in a direction generally perpendicular to the first plane and the second plane.

5. The latching relay of claim 1 further comprising:

a pair of load contacts moveable between a closed position in which power is supplied to a load and an open position in which power to the load is interrupted.

6. The latching relay of claim 5 wherein the load contacts are in the closed position when the plunger is in its first position and wherein the load contacts are in the open position when the plunger is in its second position.

7. The latching relay of claim 5 wherein the pair of load contacts comprises a stationary load contact and a moveable load contact.

8. The latching relay of claim 7 further comprising a moveable load contact arm operatively connected to said plunger, and wherein the moveable load contact is disposed on the moveable load contact arm.

9. The latching relay of claim 8 further comprising a linkage operatively connected between the plunger, the moveable load contact arm and the limit switch, wherein movement of the plunger causes simultaneous movement of both the moveable contact arm and the common contact of the limit switch via the linkage.

10. The latching relay of claim 9 wherein said linkage has an elongated slot formed therein, said elongated slot cooperating with the pin protruding from said common plunger.

11. The latching relay of claim 5 further comprising an arc extinguisher positioned adjacent the pair of load contacts, the arc extinguisher adapted to facilitate quenching of an arc created between the pair of load contacts.

12. The latching relay of claim 11 wherein the arc extinguisher comprises a plurality of arc quenching plates.

13. The latching relay of claim 11 further comprising a housing in which are disposed at least said pair of load contacts and said arc extinguisher.

14. The latching relay of claim 13 wherein said housing has formed therein at least one vent hole in order to allow gases and/or debris to be vented out of said housing.

15. The latching relay of claim 14 wherein the at least one vent hole comprises a plurality of vent holes positioned adjacent to the arc extinguisher.

16. The latching relay of claim 1 wherein said first coil, said second coil and said limit switch are all mounted on a common circuit board.

17. The latching relay of claim 1 wherein the common contact of said limit switch is biased toward electrical connection to either the first coil contact or the second coil contact, but is moveable against the bias toward electrical connection with the other of the first coil contact or the second coil contact based on the position of said plunger.

18. A latching relay comprising:

a housing;

a first coil disposed within said housing;

a second coil disposed within said housing;

a common plunger disposed within said housing and operatively connected between said first coil and said second coil such that activation of said first coil moves said plunger in a first direction to a first position and activation of said second coil moves said plunger in a second direction, opposite to the first direction, to a second position, wherein the first direction and the second direction lie in a first plane, said common plunger having a pin protruding therefrom;

a limit switch disposed within said housing and comprising a common contact, a first coil contact and a second coil contact, wherein a position of said common contact is alternately switched between electrical connection to either the first coil contact or the second coil contact based on a position of said plunger;

said first coil contact being electrically connected to said first coil and said second coil contact being electrically connected to said second coil such that when electrical power is applied to the common contact, the electrical power is alternately applied to either the first coil or the second coil depending on the position of the common contact; and a slide toggle accessible by a user through an opening formed in said housing, said slide toggle operatively connected to said common plunger and slideable together with said common plunger such that actuation of the slide toggle by the user causes manual actuation of said common plunger, said slide toggle being slideable in a second plane that is parallel to the first plane and having an elongated slot formed therein, said elongated slot extending in a direction generally perpendicular to the first plane and the second plane and cooperating with the pin protruding from said common plunger.

19. The latching relay of claim 18 wherein a portion of said slide toggle protrudes through the opening in the housing.

* * * * *